United States Patent [19]

Erickson et al.

[11] Patent Number: 5,022,359

[45] Date of Patent: Jun. 11, 1991

[54] ACTUATOR WITH ENERGY RECOVERY RETURN

[75] Inventors: Frederick L. Erickson; William E. Richeson, both of Fort Wayne, Ind.

[73] Assignee: North American Philips Corporation, New York, N.Y.

[21] Appl. No.: 557,370

[22] Filed: Jul. 24, 1990

[51] Int. Cl.[5] ..... F01L 9/04; F01L 9/02

[52] U.S. Cl. ..... 123/90.14; 123/90.11; 91/459; 91/42; 137/906; 137/625.6; 137/625.64; 92/82; 92/92

[58] Field of Search ..... 123/90.11, 90.12, 90.14, 123/46 R, 46 A; 91/42, 459; 92/82, 92; 137/906, 625.6, 625.64, 596.16

[56] References Cited

U.S. PATENT DOCUMENTS

| | | | |
|---|---|---|---|
| 3,050,943 | 8/1962 | Thorel et al. | 91/42 |
| 3,095,785 | 7/1963 | Cahill | 91/42 |
| 3,431,031 | 3/1969 | Ike | 92/92 |
| 3,479,927 | 11/1969 | Woodward | 92/92 |
| 4,597,322 | 7/1986 | Garnjust et al. | 92/82 |
| 4,852,528 | 8/1989 | Richeson et al. | 123/90.11 |
| 4,873,948 | 10/1989 | Richeson et al. | 123/90.11 |
| 4,878,464 | 11/1989 | Richeson, Jr. et al. | 123/90.11 |
| 4,899,700 | 2/1990 | Richeson, Jr. et al. | 123/90.11 |
| 4,915,015 | 4/1990 | Richeson et al. | 123/90.14 |
| 4,967,702 | 11/1990 | Richeson et al. | 123/90.14 |

*Primary Examiner*—Willis R. Wolfe
*Assistant Examiner*—Tom Moulis
*Attorney, Agent, or Firm*—Robert J. Kraus

[57] ABSTRACT

An electronically controlled actuator which compresses a fluid thereby storing potential energy as it transitions from a first to a second position is disclosed. The compressed fluid exerts a high force on the actuator and the potential energy is recovered in returning the actuator to the first position. A latching arrangement automatically locks the actuator shaft as it reaches the second position. The latching arrangement is selectively unlocked at the prescribed time to allow the stored potential energy to return the actuator to the first position.

24 Claims, 6 Drawing Sheets

ACTUATOR WITH ENERGY RECOVERY RETURN

SUMMARY OF THE INVENTION

The present invention relates generally to two position straight line motion actuators as may, for example, be utilized to actuate the poppet valves of internal combustion engines and more particularly to such actuators which are bistable and asymmetric in their operation.

The prior art has recognized numerous advantages which might be achieved by replacing the conventional mechanical cam actuated valve arrangements in internal combustion engines with other types of valve opening mechanisms which could be controlled in their opening and closing as a function of engine speed as well as engine crankshaft angular position or other engine parameters.

For example, in U.S. patent application Ser. No. 226,418 entitled VEHICLE MANAGEMENT filed in the name of William E. Richeson on July 29, 1988 now U.S. Pat. No. 4,945,870, there is disclosed a computer control system which receives a plurality of engine operation sensor inputs and in turn controls a plurality of engine operating parameters including ignition timing and the time in each cycle of the opening and closing of the intake and exhaust valves among others.

U.S. Pat. No. 4,009,695 discloses hydraulically actuated valves in turn controlled by spool valves which are themselves controlled by a dashboard computer which monitors a number of engine operating parameters. This patent references many advantages which could be achieved by such independent valve control, but is not, due to its relatively slow acting hydraulic nature, capable of achieving these advantages The patented arrangement attempts to control the valves on a real time basis so that the overall system is one with feedback and subject to the associated oscillatory behavior.

U.S. Pat. No. 4,700,684 suggests that if freely adjustable opening and closing times for inlet and exhaust valve is available, then unthrottled load control is achievable by controlling exhaust gas retention within the cylinders.

Substitutes for or improvements on conventional cam actuated valves have long been a goal. In the Richeson U.S. Pat. No. 4,794,890 entitled ELECTROMAGNETIC VALVE ACTUATOR, there is disclosed a valve actuator which has permanent magnet latching at the open and closed positions. Electromagnetic repulsion may be employed to cause the valve to move from one position to the other. Several damping and energy recovery schemes are also included.

In copending application Ser. No. 153,257, entitled PNEUMATIC ELECTRONIC VALVE ACTUATOR, filed Feb. 8, 1988 in the names of William E. Richeson and Frederick L. Erickson and assigned to the assignee of the present application, now U.S. Pat. No. 4,878,414, there is disclosed a somewhat similar valve actuating device which employs a release type mechanism rather than a repulsion scheme as in the previously identified U.S. patent. The disclosed device in this application is a jointly pneumatically and electromagnetically powered valve with high pressure air supply and control valving to use the air for both damping and as one motive force. The magnetic motive force is supplied from the magnetic latch opposite the one being released and this magnetic force attracts an armature of the device so long as the magnetic field of the first latch is in its reduced state. As the armature closes on the opposite latch, the magnetic attraction increases and overpowers that of the first latch regardless of whether it remains in the reduced state or not.

The forgoing as well as a number of other related applications all assigned to the assignee of the present invention and filed in the name of William E. Richeson or William E. Richeson and Frederick L. Erickson are summarized in the introductory portions of copending Ser. No. 07/294,728 filed in the names of Richeson and Erickson on Jan. 6, 1989 and entitled ENHANCED EFFICIENCY VALVE ACTUATOR, now U.S. Pat. No. 4,875,441.

Many of the later filed above noted cases disclose a main or working piston which drives the engine valve and which is, in turn powered by compressed air. The power or working piston which moves the engine valve between open and closed positions is separated from the latching components and certain control valving structures so that the mass to be moved is materially reduced allowing very rapid operation. Latching and release force are also reduced. Those valving components which have been separated from the main piston need not travel the full length of the piston stroke, leading to some improvement in efficiency. Compressed air is supplied to the working piston by a pair of control valves with that compressed air driving the piston from one position to another as well as typically holding the piston in a given position until a control valve is again actuated. The control valves are held closed by permanent magnets and opened by pneumatic force on the control valve when an electrical pulse to a coil near the permanent magnet neutralizes the attractive force of the magnet.

In the devices of these applications, air is compressed by piston motion to slow the piston (dampen piston motion) near the end of its stroke and then that air is abruptly vented to atmosphere. When the piston is slowed or damped, its kinetic energy is converted to some other form of energy and in cases such as dumping the air compressed during damping to atmosphere, that energy is simply lost U.S. Pat. Nos. 4,883,025 and 4,831,973 disclose symmetric bistable actuators which attempt to recapture some of the piston kinetic energy as either stored compressed air or as a stressed mechanical spring which stored energy is subsequently used to power the piston on its return trip. In either of these patented devices, the energy storage device is symmetric and is releasing its energy to power the piston during the first half of each translation of the piston and is consuming piston kinetic energy during the second half of the same translation regardless of the direction of piston motion.

An electronically controlled pneumatically powered actuator as described in our U.S. Pat. No. 4,825,528 has demonstrated very rapid transit times and infinite precise controllability. Devices constructed in accordance with this patent are capable of obtaining optimum performance from an internal combustion engine due to their ability to open and then independently close the poppet valves at any selectable crank shaft angles. In this prior patented arrangement, a source of high pressure air is required for both opening and for closing the valves. Moreover, such devices require a certain amount of duplication of structure in that symmetrical propulsion, exhaust air release, and regulated latching pressure (damping air) arrangements are needed. In this prior art configuration, substantially the same volume of air must be used to close the valve as was required to open it.

The entire disclosures of all of the above identified copending applications and patents are specifically incorporated herein by reference.

The present invention relates to an improved method of operating an actuator with the same rapid transit response and range of controllability, but with far less air utilization requirements. More specifically, the present invention relates to actuators which use a high pressure air source to open internal combustion engine valves, but use a combination of energy stored during the opening of the valves and latching/unlatching provisions for the return or closing of the valves. Since the propulsion air is only used during the opening and not the closing of the valves, the energy consumed is decreased to about one-half that required to propel the valves in both directions.

Among the several objects of the present invention may be noted the provision of an actuator which is propelled in one direction in accordance with known techniques, but then the actuator is locked or latched against the force of retained compressed air for a controlled length of time; the provision of an actuator in accordance with the previous object which, at the prescribed time, deactivates the latch, releasing an actuating piston under the force of the retained compressed air, moves in the opposite direction back to its initial position; the provision of an actuator in accordance with either of the previous objects with alternative schemes for latching and unlatching the piston; the provision of latching schemes for an actuator in accordance with the previous object which adequately and reliably hold the piston against the strong force of the retained compressed air while releasing quickly to allow a very fast return of the actuator piston to its initial position; and the provision of proper engine valve seating pressure by the application of a controlled latching force to the valve piston. These as well as other objects and advantageous features of the present invention will be in part apparent and in part pointed out hereinafter.

In general, an electronically controllable pneumatically powered valve actuating mechanism for use in an internal combustion engine of the type having engine intake and exhaust valves with elongated valve stems has a power piston with a pair of opposed faces which piston is reciprocable along an axis and is adapted to be coupled to an engine valve. A pneumatic driving arrangement unit aterally moves the piston and the engine valve in the direction of stem elongation from a valve-closed to a valve-open position. A pneumatic damping arrangement compresses a volume of air and imparts a continuously increasing decelerating force as the engine valve approaches the valve-open position and the volume of compressed air is subsequently utilized to power the piston back to the valve-closed position. The pneumatic damping arrangement includes one of the piston faces while the pneumatic driving arrangement includes the other of the piston faces. The apparatus for the utilization of the compressed volume of air includes a latch or similar device for temporarily preventing a reversal of the direction of piston motion which may for example include a hydraulic cylinder, a piston reciprocable in the hydraulic cylinder, a source for admitting hydraulic fluid to said hydraulic cylinder during motion of the piston toward the valve-open position which closes when the motion of the piston slows to a stop to temporarily prevent the egress of the fluid from the cylinder. A closed circuit hydraulic latch or a mechanical latch may also be employed.

Also in general and in one form of the invention, an asymmetrical bistable pneumatically powered actuator mechanism has a replenishable source of compressed air for causing translation of a portion of the mechanism such as a power piston in one direction and a chamber in which air is compressed during translation of the mechanism portion in said one direction with compression of the air slowing the mechanism portion translation in said one direction. Reversal of the direction of translation of the mechanism portion is temporarily prevented when the motion of that portion slows to a stop thereby capturing the mechanism portion. The mechanism portion capturing arrangement is subsequently disabled freeing the portion of the mechanism to move under the urging of the air compressed in the chamber in a direction opposite said one direction. Make-up air may be supplied to the chamber to compensate for frictional, leakage and other losses or variations as well as to provide a piston latching force when the mechanism portion is in the initial position. This make-up air may be supplied by an inlet valve for supplying a latching air pressure to the chamber at least when the piston is in the initial position to latch the piston in the initial position until piston translation is initiated by the source of compressed air. The mechanism portion typically includes a reciprocable piston having first, second and third working faces each defining a portion of corresponding first, second and third variable volume chambers the volumes of which vary linearly with piston position. The chamber in which air is compressed being the first chamber, the second chamber cooperating with the replenishable source of high pressure hydraulic fluid for causing translation of a portion of the mechanism, and the third chamber comprising a portion of the arrangement for temporarily preventing reversal of the piston motion. As an alternative, the arrangement for temporarily preventing piston motion may include a piggyback piston reciprocable with the portion of the mechanism, the piggyback piston having a pair of opposed faces defining portions of a pair of variable volume hydraulic chambers wherein the sum of the volumes of the two variable volume hydraulic chambers being a constant. A one-way check valve interconnects the two variable volume hydraulic chambers allowing free flow of fluid from a first one of the hydraulic chambers into the other hydraulic chamber, but blocking fluid flow from the other hydraulic chamber back into the first hydraulic chamber. On command, the one-way check valve overridden to allow fluid flow from the other hydraulic chamber back into the first hydraulic chamber thereby freeing the piston to move under the urging of the compressed air back to its initial position.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the s cope of the invention in any manner.

DESCRIPTION OF THE PREFERRED EMBODIMENT

Figure 1:
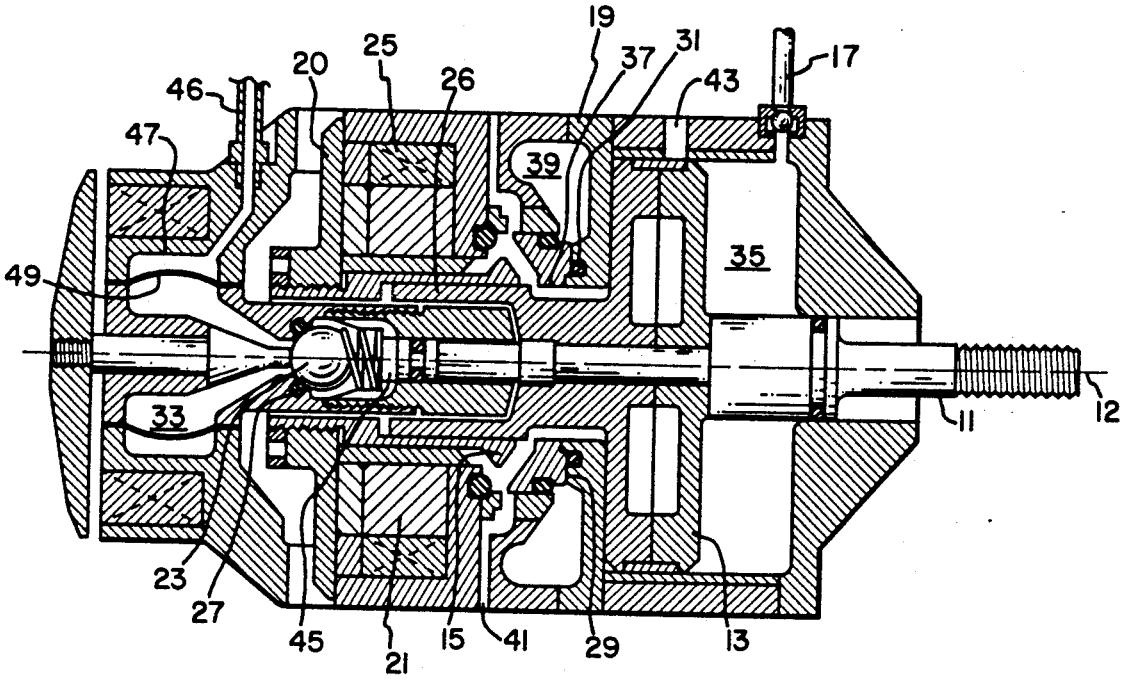
FIG. 1 is a view in cross-section of a valve actuating mechanism in its initial or valve-closed position illustrating the invention in one form.

The overall valve actuator is illustrated in cross-section in FIG. 1 in conjunction with which various component locations and functions in moving a poppet valve or other component (not shown) from a first position (in which the poppet valve is seated) to a second position (in which the poppet valve is fully open) will be described. Motion in the opposite direction will be quite different and will be described subsequently. FIG. 1 illustrates the actuator at rest before any command is given to energize the unit. The actuator includes a shaft or stem 11 which may form a part of or connect to an internal combustion engine poppet valve. The actuator also includes a low mass reciprocable piston 13, and a reciprocating or sliding control valve member 15 enclosed within a housing 19. The piston and control valve reciprocate along the common axis 12. The control valve member 15 is latched in one (the closed) position by permanent magnet 2 and may be dislodged from that latched position by energization of coil 25. The permanent magnet latching arrangement also includes ferromagnetic latch plate 20 which is an iron or similar ferromagnetic member attached to and movable with the air control valve member 15. The control valve member or shuttle valve 15 cooperates with the cylindrical end portion 26 of piston 13 as well as with the housing 19 to achieve the various porting functions during operation. The housing 19 has a high pressure inlet port 39, a low pressure outlet port 41 and an intermediate pressure port extending from the sidewall aperture 43. The low pressure may be about atmospheric pressure while the intermediate pressure is about ten psi. above atmospheric pressure and the high pressure is on the order of 100 psi. gauge pressure.

Figure 2:
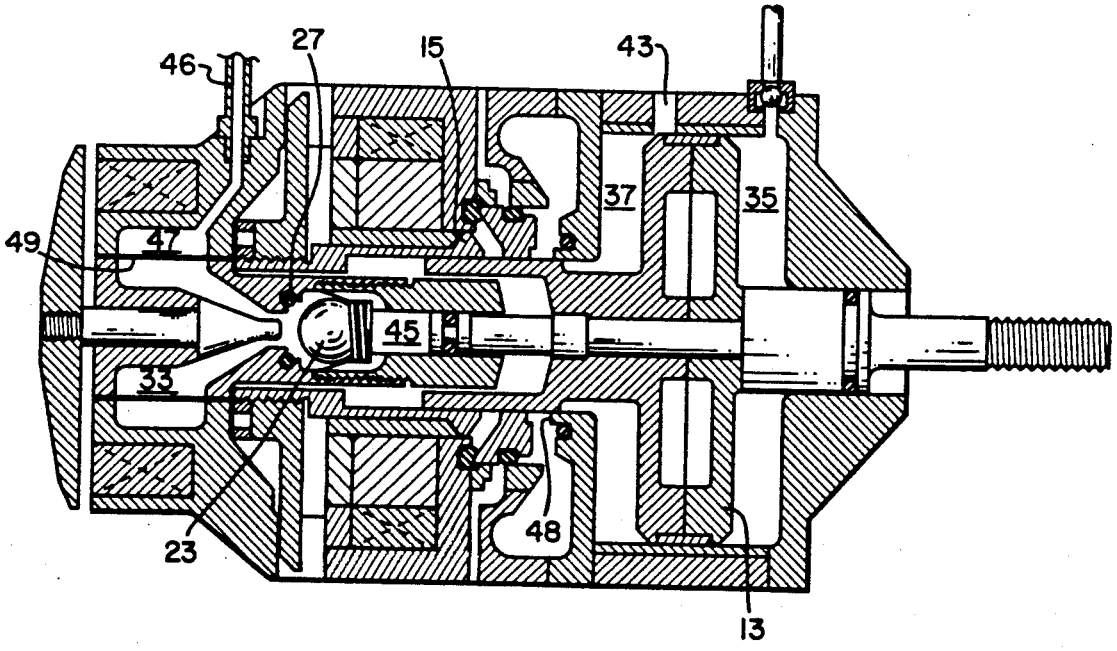
FIG. 2 is a view in cross-section similar to FIG. 1, but illustrating the mechanism having transitioned half way toward its second or valve-open position.
Figure 3:
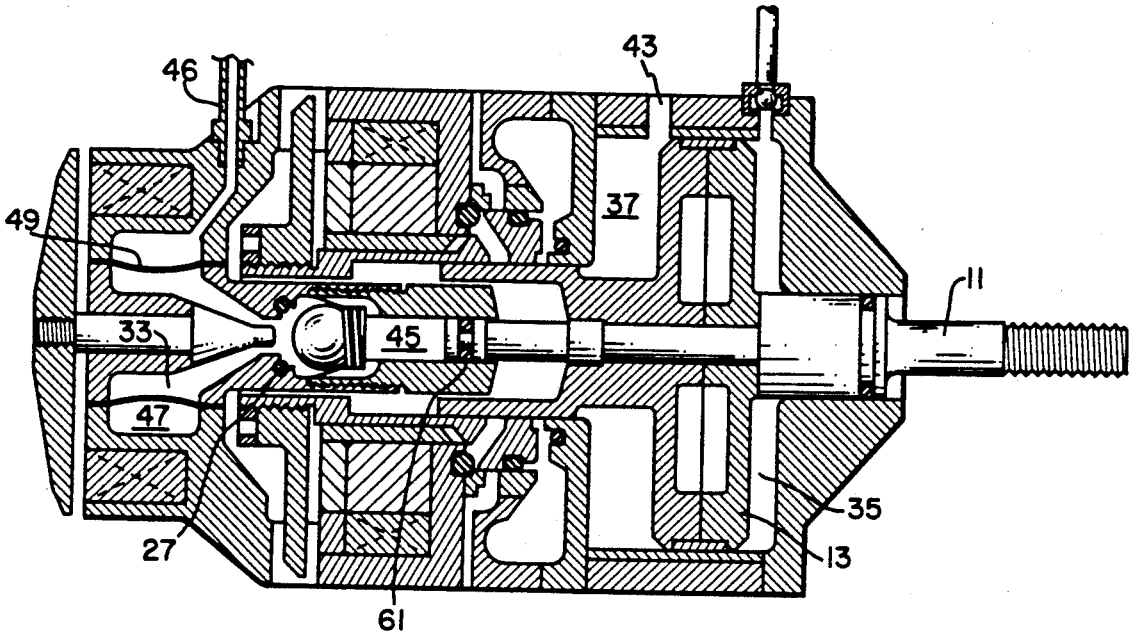
FIG. 3 is a view in cross-section similar to FIG. 1, but illustrating the mechanism having transitioned three-quarters of the way toward its second position.
Figure 4:
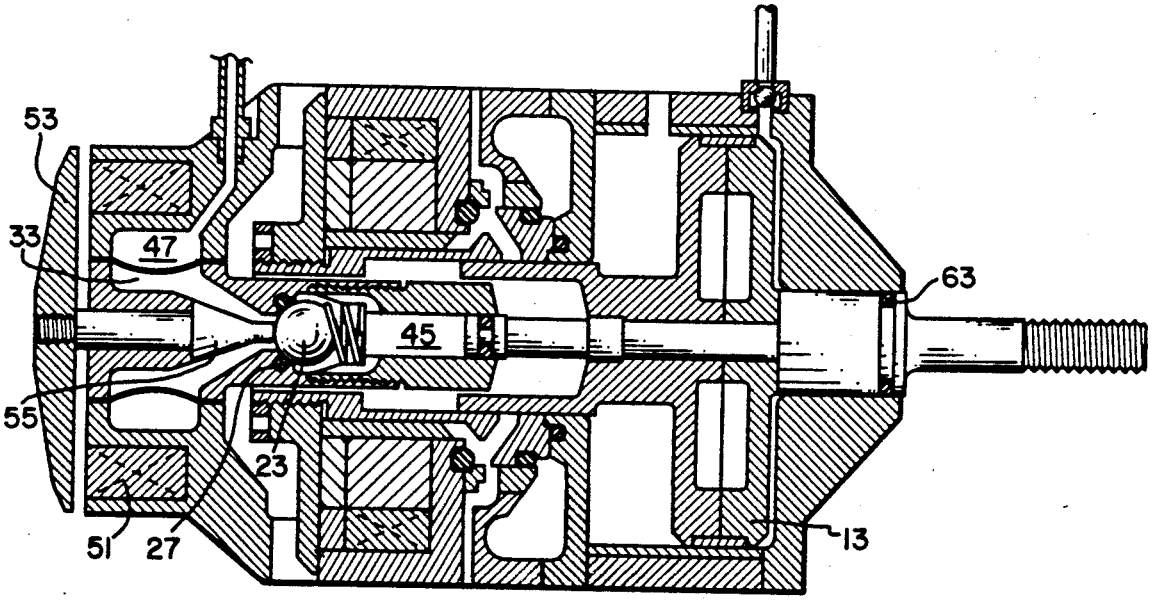
FIG. 4 is a view in cross-section similar to FIG. 1, but illustrating the mechanism having transitioned completely to its valve-open position.
Figure 6:
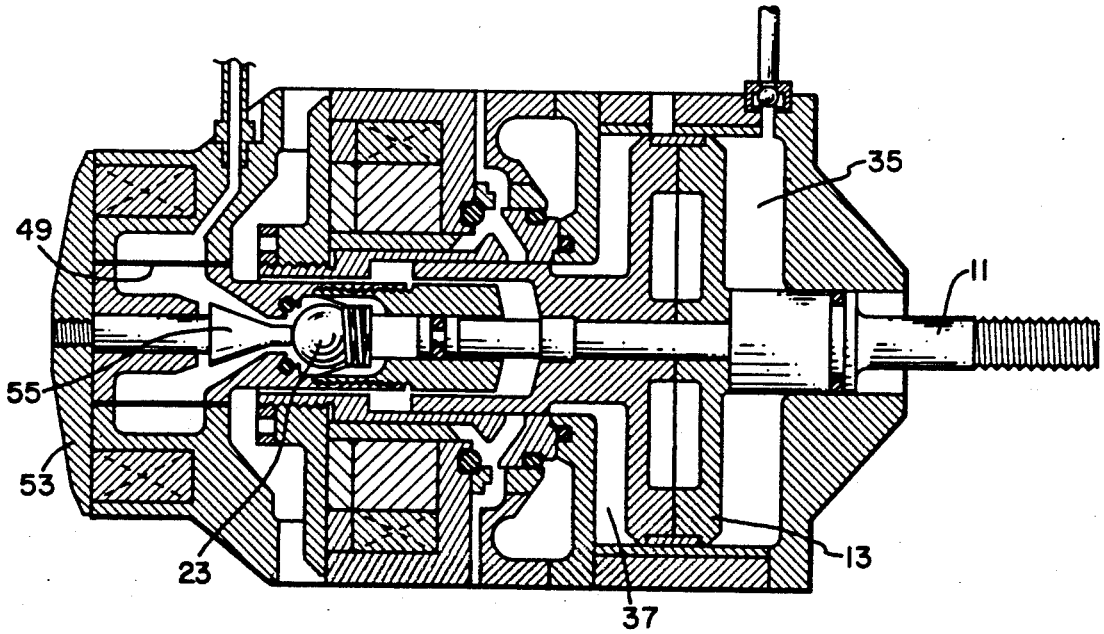
FIG. 6 is a view in cross-section similar to FIG. 1, but illustrating the mechanism having transitioned half way back toward its valve-closed position.
Figure 7:
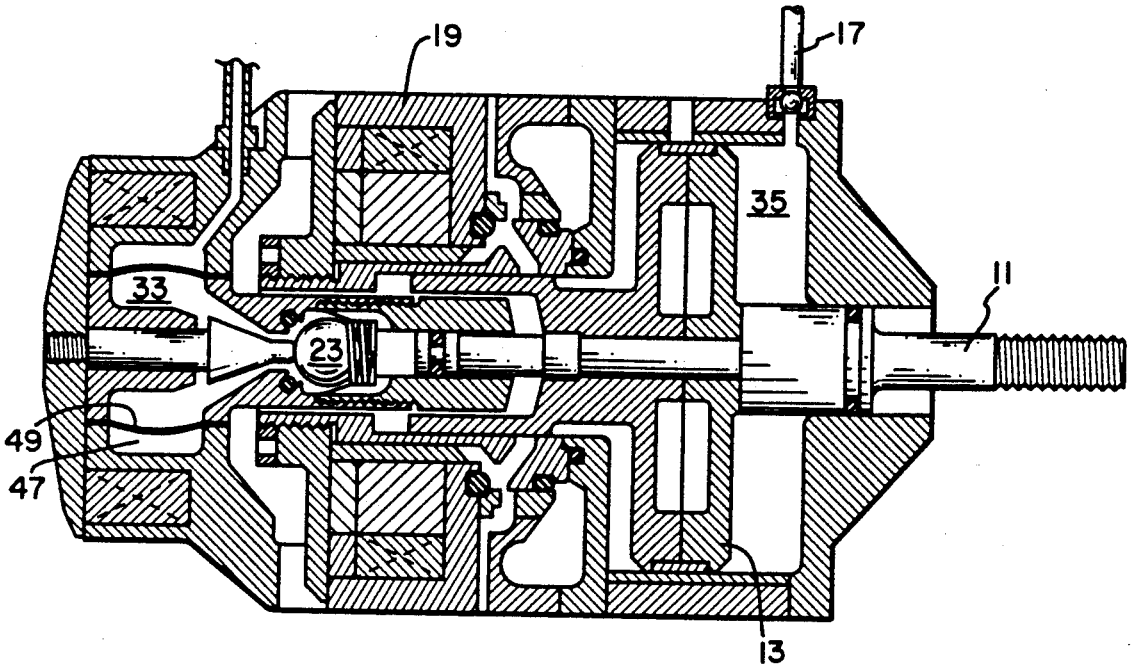
FIG. 7 is a view in cross-section similar to FIG. 1, but illustrating the mechanism having transitioned three-quarters of the way back toward its valve-closed position.

When the valve actuator is in its initial state with piston 13 in the extreme leftward position and with the air control valve 15 latched closed, the annular abutment end surface 29 of the control valve seals against an O-ring 31. This seals the pressure in cavity 39 and prevents the application of any moving force to the main piston 13. In this position, the main piston 13 is being urged to the left (latched) by the pressure in cavity or chamber 35 which is greater than the pressure in chamber or cavity 37. This latching pressure in chamber 35 is maintained by an intermediate, e.g., 10 psi., pressure source coupled to the inlet of the one-way check valve 17. When it is desired to open, e.g., an associated engine intake or exhaust valve, coil 25 is energized and the current flow therein induces a magnetic field opposing the field of the permanent magnet 21. With the magnetic latching force on plate 20 thus essentially neutralized, the unbalanced force of the high pressure air against surface 29 moves the control valve 15 leftward as viewed from the position of FIG. 1 to the position illustrated in FIG. 2 where an annular opening has formed near the O-ring 31 between the control valve 15 and edge 48 of the housing 19 which opening has allowed high pressure air from source chamber 39 to enter chamber 37 powering the piston toward the right. In FIG. 2, the piston 13 has moved from its leftmost position nearly half the distance to its other bistable position. As piston 13 moves toward the right, it compresses air and stores energy in chamber 35. As the air in chamber 35 is compressed, slow down and damping of piston motion occurs. In FIG. 3, the piston 13 has uncovered the intermediate or "latching" pressure aperture 43 releasing any unexpanded air to atmosphere and removing the driving force from the piston. The air captured in chamber 35 is being compressed to dampen or slow the piston motion. At the point where the energy of compression of air in chamber 35 plus the system friction is the same as the energy expended by expansion of the compressed air in chamber 37, the piston comes to rest in its rightmost (engine valve open) or second position as shown in FIG. 4. Were the piston not captured at this time, the compressed air in chamber 35 would simply cause the piston to rebound and retrace its path back to the valve closed position, however, an automatic latch grabs the piston and holds it against the high force of the compressed air in the valve-open position until commanded to release it. In FIG. 6. the piston has been released allowing the compressed air to expand driving the piston back toward the initial position.

In the preferred form, the latch for capturing the piston incorporates a fixed location hydraulic cylinder together with a piston connected to and movable with the powered piston 13 and shaft assembly. The fixed cylinder and piston are configured so that as the main power piston 13 is driven from the first to the second position by source air pressure as described above, the hydraulic piston pulls a relatively non-compressible fluid through an open one-way valve into the cylinder. This fluid can be pressurized to help overcome any restrictions which might hinder its entry into the cylinder and to limit any tendency for the fluid to cavitate leaving an undesirable vacuum or void in the cylinder. The fluid fills the cylinder volume up to the point where the main power piston reaches the second position. When the main piston begins to reverse direction under the urging of the recently compressed air, the one-way valve closes to retain the fluid in the cylinder halting movement of the main piston. The fluid pressure in the cylinder holds the one-way valve closed, thus, the main piston will remain at the second position until a command is given to release the latch. The release function is provided by an electromagnetic solenoid operated plunger which physically displaces the one-way valve from its closed position allowing the trapped fluid to flow back out of the hydraulic cylinder. When the fluid is allowed to empty from the cylinder, the high pressure air trapped in chamber 35 rapidly pushes the main piston from the second position back to the first position.

Ball 23 and valve seat 27 function as a one-way or check valve. In the transition between FIGS. 1 and 2, the ball 23 has been lifted off the valve seat 27 allowing fluid from chamber 33 to flow past the ball 23 and into the expanding chamber or cylinder 45. Chamber 47 is filled with pressurized air and effectively pressurizes the fluid in chamber 33 by way of a flexible membrane 49 to aid in the transfer of fluid into the cylinder 45. A small amount of make-up air may be added to chamber 47 by way of air inlet 46. Note that the membrane 49 is bowed radially outwardly in FIG. 1, when chamber 33 is full of fluid, reaches a neutral position in FIG. 2, and is bowed radially inwardly in FIG. 3 where much of the fluid has exited the chamber 33 and entered into chamber 45.

In FIG. 2, the main piston is just uncovering the port 43 while in FIG. 3 this port is well open and the pressurized air in chamber 37 is vented to atmosphere removing the rightward pneumatic driving force from the piston 13. FIG. 3 illustrates the piston position as it is slowing down and compressing air in chamber 35. In FIG. 4, the piston has reached its second position and the air in chamber 35 is highly compressed. The high force on the piston due to this high pressure air in chamber 35 causes the fluid in cylinder 45 to attempt to exit past the ball 23 of the check valve causing the ball to close and seat firmly on the annular seal or seat 27. When the check valve closes, fluid entrapped in chamber 45 holds the piston 13 in its rightmost or valve-open position against the pressure of the air compressed in chamber 35.

Figure 5:
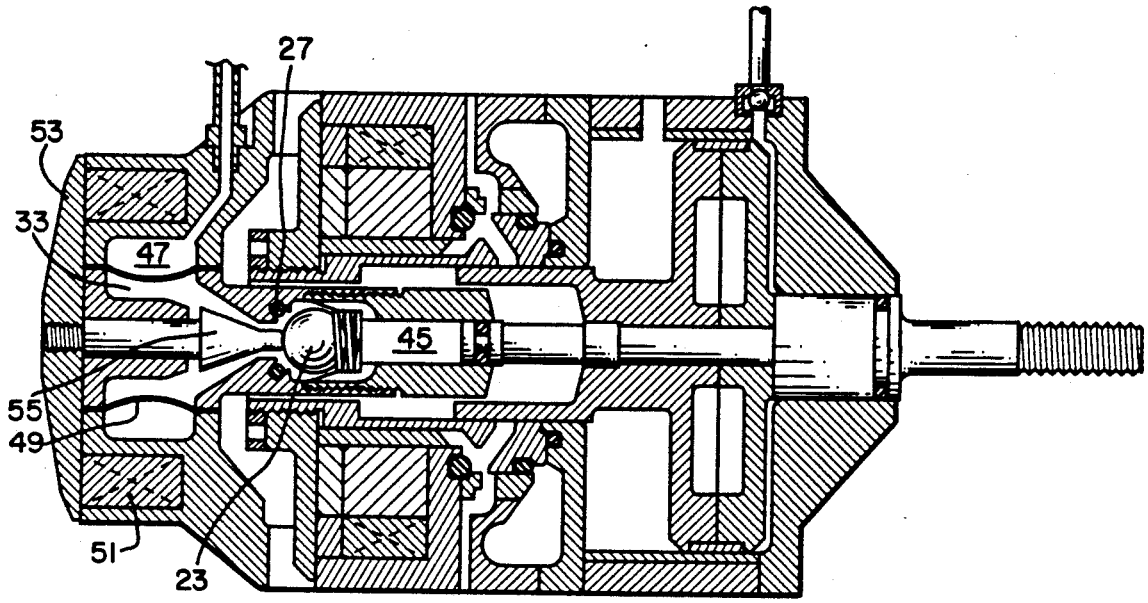
FIG. 5 is a view in cross-section similar to FIG. 1 again illustrating the mechanism in its valve-open position, but at the moment the latch is released.
Figure 8:
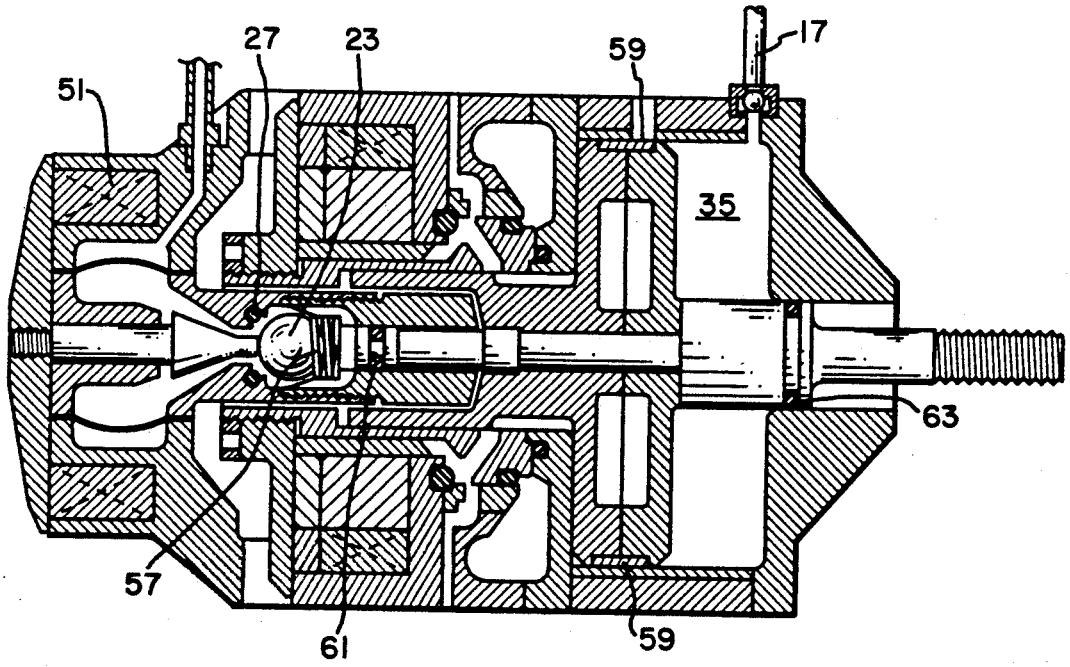
FIG. 8 is a view in cross-section similar to FIG. 1, but illustrating the mechanism having reached its initial position.

A comparison of FIGS. 4 and 5 will illustrate the manner in which the valve actuator responds to a command to return to the first position and close the engine valve. Upon command, a current is caused to flow in the coil 51 attracting ferromagnetic plate 53 to close and moving the centrally located plunger 55 sharply into engagement with the ball 23 unseating the ball from the annular seal 27 and allowing the fluid to exit chamber 45 and flow back into chamber 33. Note that in the sequence of FIGS. 5–8, the membrane 49 swells radially outwardly as chamber 33 is refilled. Note also that in the sequence of FIGS. 5–8 the ball is held in its open position by the plunger 55. With fluid free to exit chamber 45, the latching is effectively nullified and the highly compressed air in chamber 35 forces the piston leftwardly as viewed toward its initial or first position. When the piston has completed the trip to its initial position as in FIG. 8, the solenoid 51 may thereafter be deenergized allowing spring 57 to return ball 23 to rest against seat 27 and the device will again assume the configuration shown in FIG. 1.

As thus far described, actuator motion toward the valve-open position is slowed or damped by the compressing of air in chamber 35. By capturing the piston just as it reaches a complete stop, the energy of piston motion has been converted into and is stored as potential energy. This potential energy is later used (when the piston is released) to power the piston back to the valve-closed position. Since internal combustion engine valves spend more time in the closed than in the open position, the high pressure compressed air need only be held a short time, however, it is possible to instead use the compressed air to drive the piston from the valve-closed to the valve-open position with perhaps some sacrifice in the form of leakage losses. Such leakage could be either air or hydraulic latching fluid and could occur at a number of locations including the latching pressure air inlet check valve 17, around annular piston seal 59, past the main shaft seal 63, around the small annular piston seal 61, or between ball 23 and its seat 27.

There has been thus far described a method of storing potential energy in the form of air compressed in a chamber 35 by a piston 13 which includes driving the piston in a direction (to the right as viewed) to compress air in the chamber, and at the appropriate time. removing the piston drive by closing the valve 15 and allowing the piston to be slowed by the force of the air being compressed in chamber 35. The piston is captured near the time when its motion has slowed to a stop and prior to any significant leftward motion in a direction opposite the air compressing direction. The piston is subsequently released on command allowing the compressed air stored energy to propel the piston back toward the left as viewed in a direction opposite the air compressing direction.

Figure 9:
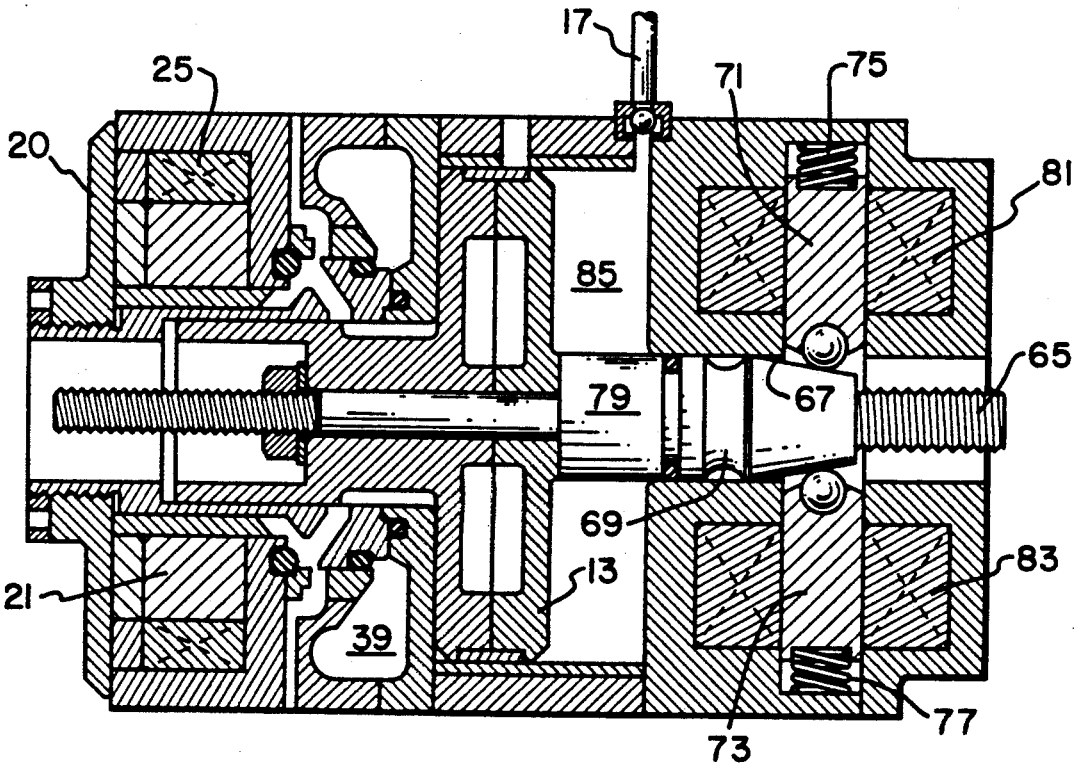
FIG. 9 is a view in cross-section similar to FIG. 1, but illustrating a variation on the latching arrangement.

A second embodiment of the invention utilizing a mechanical scheme for capturing the piston at its extreme righthand position is shown in FIG. 9. The portion of the system shown in FIG. 9 for translating the piston and shaft assembly 69 toward the right as viewed is the same as previously discussed in conjunction with FIGS. 1–8. The piston capture or latching mechanism is, however, quite different. Here the main actuator shaft 65 has angled ramp surfaces 67 which lead to sockets 69. A pair of roller ended plungers 71 and 73 are urged toward one another and into engagement with ramp surface 67 by springs 75 and 77. Solenoids 81 and 83 are energizable on command to pull the plungers 71 and 73 out of the detent 69 whereupon, previously trapped and highly compressed air in chamber 85 propels the piston and shaft assembly 79 back to the valve-closed or initial position. Unlike the latching scheme in FIGS. 1–8, the solenoids 81 and 83 need only be energized sufficiently long to pull the ball plungers from the detent 69 and as soon as the shaft has moved a short distance, they may be deenergized because the ball ends are no longer aligned with and cannot fall back into the detent 69.

Figure 10:
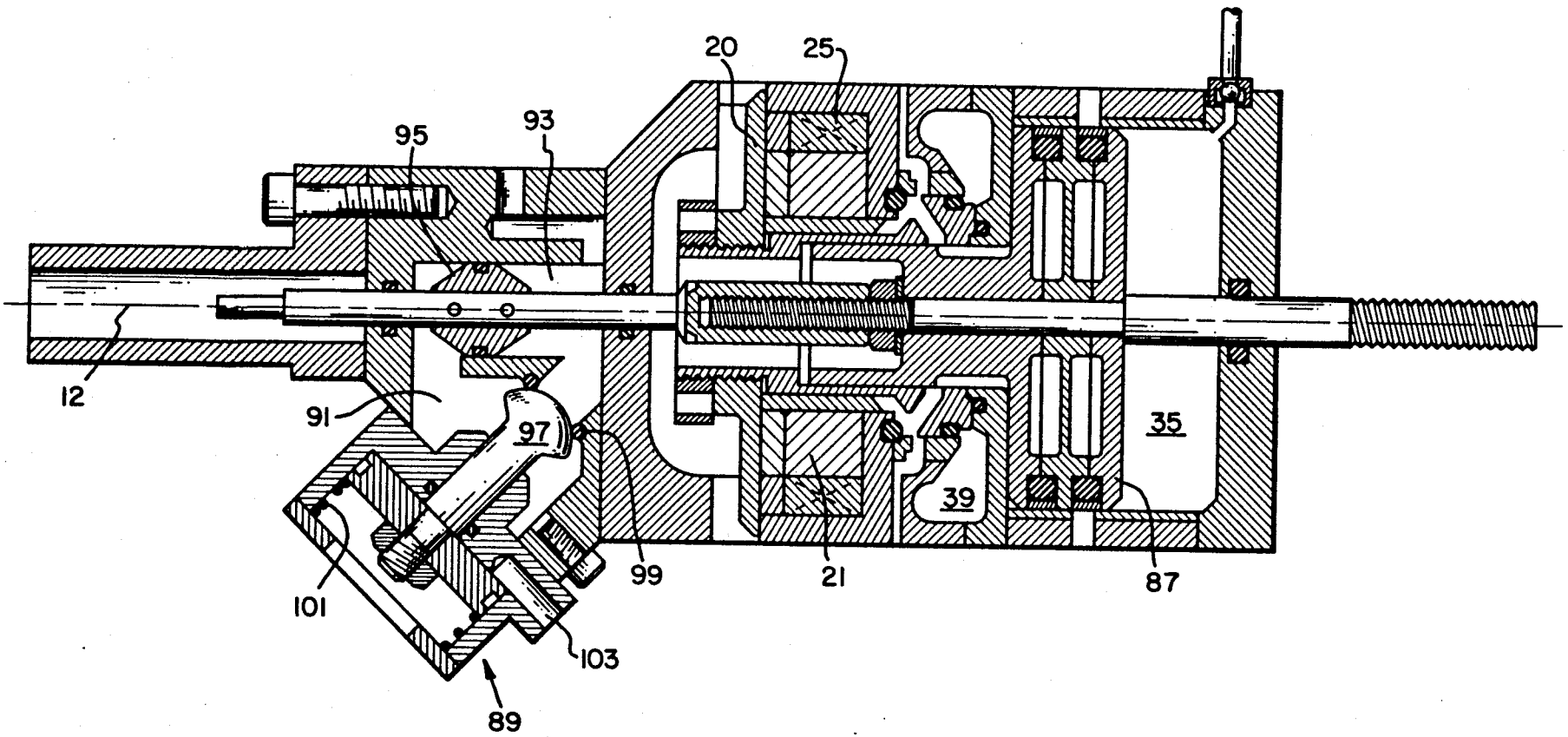
FIG. 10 is a cross-sectional view similar to FIGS. 1 and 9, but illustrating a further variation of the latching arrangement.

A third embodiment of the invention is shown in FIG. 10. Piston seal 59 of the earlier discussed embodiments has been replaced by a pair of O-rings, but again, rightward propulsion of the piston 87 is substantially as already described. When the piston 87 reaches its right-hand or valve-open position a constant volume hydraulic latch 89 holds it there until a release command is given. In particular, a constant volume of fluid occupies the chambers 91 and 93. So long as valve 97 is held open so that fluid may freely pass by the valve seal 99, the motion of the piggyback piston 95 which is fixed to reciprocate with piston 87 simply causes one of the chambers 91 and 93 to increase in volume while the other is decreasing. The fluid simply moves around a closed circuit or "racetrack" as the piston reciprocates. Such an arrangement provides a closed hydraulic system requiring no external supply of hydraulic fluid. Valve 89 is a one-way valve loaded by spring 101 toward its closed position. As piggyback piston 95 moves toward the right, fluid moves through the valve 97, chamber 93 contracts and chamber 91 expands.

When piston 87 reaches the valve-open position and high pressure air in chamber 35 attempts to move the piston back toward the left, the valve 97 closes and prevents any significant leftward motion. A return command in the form of high pressure air or hydraulic fluid supplied to inlet 103 forces piston 105 against the urging of spring 101 to open the valve 97 allowing the closed circuit fluid to flow back from chamber 91 into chamber 93 as the piston 87 returns to its valve-closed position.

From the foregoing, it is now apparent that a novel asymmetrical valve actuating mechanism has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. An asymmetrical bistable pneumatically powered actuator mechanism comprising:

a replenishable source of compressed air for causing translation of a portion of the mechanism in one direction;

a chamber in which air is compressed during translation of the mechanism portion in said one direction, compression of the air slowing the mechanism portion translation in said one direction;

means for temporarily preventing reversal of the direction of translation of the mechanism portion when the motion of that portion slows to a stop.

2. The asymmetrical bistable pneumatically powered actuator mechanism of claim 1 further comprising means operable on command to disable the temporarily preventing means freeing the portion of the mechanism to move under the urging of the air compressed in the chamber in a direction opposite said one direction.

3. The asymmetrical bistable pneumatically powered actuator mechanism of claim 1 further comprising means for supplying makeup air to said chamber to compensate for frictional and other losses.

4. The asymmetrical bistable pneumatically powered actuator mechanism of claim 1 wherein the mechanism portion includes a hydraulic piston, the means for temporarily preventing including said hydraulic piston, a hydraulic cylinder in which said piston reciprocates. means for admitting hydraulic fluid to said hydraulic cylinder during translation of the mechanism portion in said one direction, said means for admitting closing when the motion of the portion slows to a stop to temporarily prevent the egress of the fluid from the cylinder.

5. The asymmetrical bistable pneumatically powered actuator mechanism of claim 4 further including solenoid means operable on command to hold open the means for admitting thereby allowing the egress of fluid from the cylinder and motion of the mechanism portion in a direction opposite said one direction.

6. The asymmetrical bistable pneumatically powered actuator mechanism of claim 1 wherein said mechanism portion includes a reciprocable piston having first, second and third working faces each defining a portion of corresponding first, second and third variable volume chambers the volumes of which vary linearly with piston position, said chamber being the first chamber, the second chamber cooperating with the replenishable source of high pressure hydraulic fluid for causing translation of a portion of the mechanism, and the third chamber comprising a portion of the means for temporarily preventing reversal.

7. The asymmetrical bistable pneumatically powered actuator mechanism of claim 1 further including an inlet valve for supplying a latching air pressure to said chamber at least when the piston is in the initial position to latch the piston in the initial position until piston translation is initiated by the source of compressed air.

8. The asymmetrical bistable pneumatically powered actuator mechanism of claim 1 wherein the means for temporarily preventing includes at least one detent member movable generally orthogonal to the said one direction, the detent member being spring-biased toward the mechanism portion, the mechanism portion including a ramp inclined obliquely to said one direction, and a detent depression, the ramp engaging the detent member during translation in said one direction to force the detent member away from the mechanism portion until the detent member comes into alignment with the depression whereupon the detent member is driven under the urging of the spring bias into locking engagement with the depression.

9. The asymmetrical bistable pneumatically powered actuator mechanism of claim 8 further comprising means for temporarily disabling the means for temporarily preventing thereby allowing the compressed air in the chamber to propel the mechanism portion in a direction opposite the air compressing direction.

10. The asymmetrical bistable pneumatically powered actuator mechanism of claim 9 wherein the means for disabling comprises a solenoid selectively energizable to overpower the spring bias and move the detent means against the spring bias out of the detent depression.

11. The asymmetrical bistable pneumatically powered actuator mechanism of claim 1 wherein the means for temporarily preventing includes a piggyback piston reciprocable with the portion of the mechanism, the piggyback piston having a pair of opposed faces defining portions of a pair of variable volume hydraulic chambers with the sum of the volumes of the two variable volume hydraulic chambers being a constant, a one-way check valve interconnecting the two variable volume hydraulic chambers allowing free flow of fluid from a first one of the hydraulic chambers into the other hydraulic chamber, but blocking fluid flow from the other hydraulic chamber back into the first hydraulic chamber.

12. The asymmetrical bistable pneumatically powered actuator mechanism of claim 11 wherein the means for temporarily preventing further comprises means operable on command to override the one-way check valve and allow fluid flow from the other hydraulic chamber back into the first hydraulic chamber.

13. An electronically controllable pneumatically powered valve actuating mechanism for use in an internal combustion engine of the type having engine intake and exhaust valves with elongated valve stems, the actuator comprising;

a power piston having a pair of opposed faces, the piston being reciprocable along an axis and adapted to be coupled to an engine valve;

pneumatic motive means for unilaterally moving the piston, thereby causing the engine valve to move in the direction of stem elongation from a valve-closed to a valve-open position; and pneumatic damping means for compressing a volume of air and imparting a continuously increasing decelerating force as the engine valve approaches the valve-open position; and means operable on command for utilizing the compressed volume of air to power the piston back to the valve-closed position.

14. The electronically controllable pneumatically powered valve actuating mechanism of claim 13 wherein the pneumatic damping means comprises one of the piston faces.

15. The electronically controllable pneumatically powered valve actuating mechanism of claim 13 wherein the pneumatic motive means comprises one of the piston faces.

16. The electronically controllable pneumatically powered valve actuating mechanism of claim 13 wherein the means for utilizing the compressed volume of air includes means for temporarily preventing a reversal of the direction of piston motion including a hydraulic cylinder, a piston reciprocable in the hydraulic cylinder, means for admitting hydraulic fluid to said hydraulic cylinder during motion of the piston toward the valve-open position, said means for admitting closing when the motion of the piston slows to a stop to temporarily prevent the egress of the fluid from the cylinder.

17. The electronically controllable pneumatically powered valve actuating mechanism of claim 13 wherein the means for utilizing the compressed volume of air includes means for holding the power piston near the valve-open position comprising a piggyback piston reciprocable with the power piston, the piggyback piston having a pair of opposed faces defining portions of a pair of variable volume hydraulic chambers with the sum of the volumes of the two variable volume hydraulic chambers being a constant, a one-way check valve interconnecting the two variable volume hydraulic chambers allowing free flow of fluid from a first one of the hydraulic chambers into the other hydraulic chamber, but blocking fluid flow from the other hydraulic chamber back into the first hydraulic chamber.

18. The electronically controllable pneumatically powered valve actuating mechanism of claim 17 wherein the means for holding the power piston further comprises means operable on command to override the one-way check valve and allow fluid flow from the other hydraulic chamber back into the first hydraulic chamber.

19. A bistable electronically controlled fluid powered transducer having an armature reciprocable along an axis between first and second positions, a control valve reciprocable along said axis between open and closed positions; magnetic latching means for holding the control valve in the closed position; an electromagnetic arrangement for temporarily neutralizing the effect of the magnetic latching means to release the control valve to move from the closed to the open position; hydraulic means enabled when the control valve moves to the open position for powering the armature from the first position to the second position, a chamber in which air is compressed during motion of the armature from the first position to the second position, compression of the air slowing armature motion as it nears the second position, means for temporarily preventing reversal of armature motion when the motion of the armature has slowed to a stop, the temporarily preventing means being disableable on command to allow the air compressed in the chamber to return the armature to the first position,

20. The bistable electronically controlled pneumatically powered transducer of claim 19 wherein the armature comprises a power piston reciprocable along said axis and adapted to be coupled to an internal combustion engine valve, the power piston having a pair of opposed faces one of which responds to compressed air admitted to the transducer by the control valve to propel the piston from the first position to the second position and the other of which compresses entrapped air within the transducer during motion from the first position to the second position.

21. The bistable electronically controlled pneumatically powered of claim 20 wherein the means for temporarily preventing comprises a piggyback piston reciprocable with the power piston, the piggyback piston having a pair of opposed faces defining portions of a pair of variable volume hydraulic chambers with the sum of the volumes of the two variable volume hydraulic chambers being a constant, a one-way check valve interconnecting the two variable volume hydraulic chambers allowing free flow of fluid from a first one of the hydraulic chambers into the other hydraulic chamber, but blocking fluid flow from the other hydraulic chamber back into the first hydraulic chamber.

22. The bistable electronically controlled pneumatically powered of claim 21 wherein the means for temporarily preventing further comprises means operable on command to override the one-way check valve and allow fluid flow from the other hydraulic chamber back into the first hydraulic chamber.

23. A method of storing potential energy in the form of air compressed in a chamber by a piston comprising the steps of:

driving the piston in a direction to compress air in the chamber;

removing the piston drive thereby allowing the piston to be slowed by the force of the air being compressed;

capturing the piston near the time when its motion has slowed to a stop and prior to any significant motion in a direction opposite the air compressing direction.

24. The method of claim 23 including the further step of releasing the piston allowing the compressed air stored energy to propel the piston in a direction opposite the air compressing direction.

* * * * *